US006615986B2

(12) United States Patent
Pirro et al.

(10) Patent No.: US 6,615,986 B2
(45) Date of Patent: Sep. 9, 2003

(54) BATTERY PACKAGE

(75) Inventors: Jeffrey P. Pirro, Marcellus, NY (US); Andrew C. Schweitzer, Camillus, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 09/837,668

(22) Filed: Apr. 18, 2001

(65) Prior Publication Data

US 2002/0153278 A1 Oct. 24, 2002

(51) Int. Cl.[7] ..... B65D 85/00
(52) U.S. Cl. ..... 206/704; 206/459.5; 206/467
(58) Field of Search ..... 206/704, 459.5, 206/831, 459.1, 461, 462, 467, 469, 470, 471, 806, 762, 764, 766

(56) References Cited

U.S. PATENT DOCUMENTS

| | | | | | |
|---|---|---|---|---|---|
| 610,522 | A | * | 9/1898 | Brown | 206/831 |
| 1,116,043 | A | * | 11/1914 | Elliott | 206/831 |
| 2,359,679 | A | * | 10/1944 | Roehrl | 206/831 |
| 2,790,587 | A | * | 4/1957 | Contant | 206/831 |
| 3,187,889 | A | * | 6/1965 | Sinclair | 206/704 |
| 3,476,239 | A | * | 11/1969 | Jacob | 206/461 |
| 3,881,257 | A | * | 5/1975 | Chasen | 206/461 |
| 3,990,578 | A | * | 11/1976 | Roeser | 206/461 |
| 4,953,700 | A | * | 9/1990 | DeDino | 206/704 |
| 6,039,185 | A | | 3/2000 | Pedracine et al. | |
| D454,783 | S | * | 3/2002 | Pirro et al. | D9/415 |

FOREIGN PATENT DOCUMENTS

| | | |
|---|---|---|
| CA | 2212112 A1 | 2/1999 |
| EP | 0473190 A2 | 3/1992 |
| JP | 2000-43936 A | 2/2000 |

OTHER PUBLICATIONS

Rayovac Loud 'n Clear Package Front (photo) published before Apr. 18, 2000.

Rayovac Loud 'n Clear Package Side (photo) published before Apr. 18, 2000.

Rayovac Loud 'n Clear Package Back (photo) published before Apr. 18, 2000.

Rayovac Loud 'n Clear Package Inside Front and Back (photo) published before Apr. 18, 2000.

* cited by examiner

*Primary Examiner*—Shian Luong
(74) *Attorney, Agent, or Firm*—Russell H. Toye, Jr.

(57) ABSTRACT

A battery package for holding a battery dispenser and batteries including a backing and a battery holder. The backing includes a first board and a second board, with the second board having a first sheet pivotally connected to a second sheet. The first board is connected to the first sheet of the second board. The battery holder is connected and extends from the first board. The first sheet and the second sheet of the second board include instructions for using the battery dispenser and the batteries. The backing has a closed position for displaying the battery dispenser and the batteries and an open position wherein the first sheet of the second board and the first board are flipped upward about the second sheet of the second board to allow a user of the batteries to read the instructions.

27 Claims, 9 Drawing Sheets

BATTERY PACKAGE

BACKGROUND OF THE INVENTION

The present invention relates to packaging, and in particular to a package for holding batteries.

Electrochemical cells (i.e., batteries) are commonly employed to supply voltage for electrically operated devices, particularly for portable electrically operated devices. Currently, a number of popular alkaline cells of the generally cylindrical shape are commercially available in industry-recognized, standard sizes, including D-, C-, AA-, AAA-, and AAAA-size cells, as well as other sizes and configurations. Furthermore, disc-shaped batteries are also commercially available for small electrically operated devices, such as hearing aids.

Heretofore, batteries have been shipped and displayed in stores in battery packages having a cardboard backing and a battery receptacle portion holding the batteries. The cardboard backing has been a single board or card. The single board is typically rectangular, with edges of the board being adjacent the periphery of the battery receptacle portion. Information about the manufacturer of the batteries and the typical devices for use with the batteries are typically located on the rear face of the board. However, when the users of the batteries have poor vision, the information on the rear face of the board can be difficult to read. When the batteries are sold with a battery dispenser, additional information may need to be printed on the package to explain how to use the dispenser, thereby resulting in even smaller print on the package. Furthermore, the board or card often is torn or destroyed to remove the batteries from the package, thereby destroying any information on the board or card.

Accordingly, an apparatus solving the aforementioned disadvantages and having the aforementioned advantages is desired.

SUMMARY OF THE INVENTION

One aspect of the present invention is to provide a battery package for holding a battery dispenser and batteries including a backing and a battery holder. The backing includes a first board and a second board. The second board has a first sheet pivotally connected to a second sheet. Furthermore, the first board is connected to the first sheet of the second board. The battery holder is connected to the backing and extends from the first board. The battery holder is configured to retain the battery dispenser and the batteries. The first sheet and the second sheet of the second board include instructions for using the battery dispenser and the batteries. The backing has a closed position for displaying the batteries and an open position wherein the first sheet of the second board and the first board are flipped upward about the second sheet of the second board to allow a user of the batteries to read the instructions.

Another aspect of the present invention is to provide a battery package including a backing, a battery holder and batteries. The backing includes a first panel and a second panel, with the second panel having a first sheet pivotally connected to a second sheet. Furthermore, the first panel is connected to the first sheet of the second panel. The battery holder is connected to the backing and extends from the first panel. The batteries are located within the battery holder. At least a portion of the first sheet and the second sheet of the second panel includes instructions for using the battery dispenser and the batteries. The backing has a closed position for displaying the batteries and an open position wherein the first sheet of the second panel and the first panel are flipped upward about the second sheet of the second panel to allow a user of the batteries to read the instructions.

Accordingly, the users of the batteries sold in the battery package can easily read the instructions on the battery package because the instructions can be written in large font and include large illustrations. Furthermore, the instructions can be sold with the backing of the battery package without the need for an extra sheet of paper with the instructions for using the batteries and the battery dispenser. Additionally, the effective printed area on the package is significantly increased without requiring any significant shelf space. The battery package is efficient in use, economical to manufacture, capable of a long life, and particularly adapted for the proposed use.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
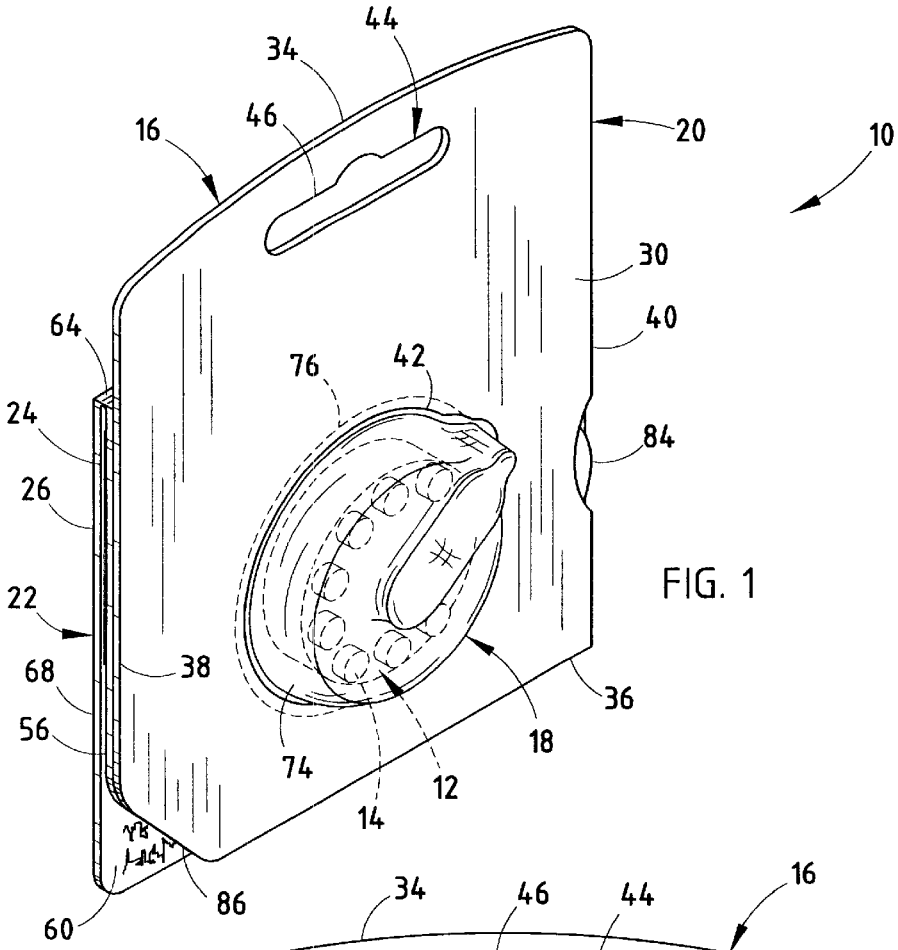
FIG. 1 is a perspective view of the battery package in a closed position of the first embodiment of the present invention.
Figure 2:
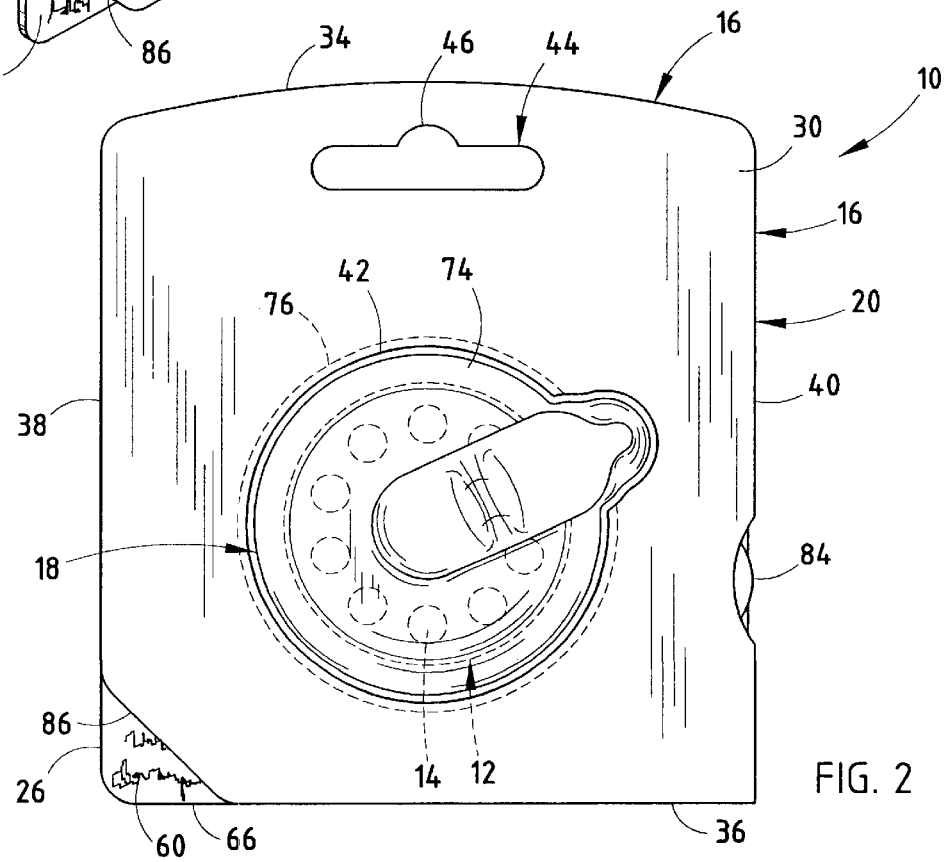
FIG. 2 is a front view of the battery package of the first embodiment of the present invention.
Figure 3:
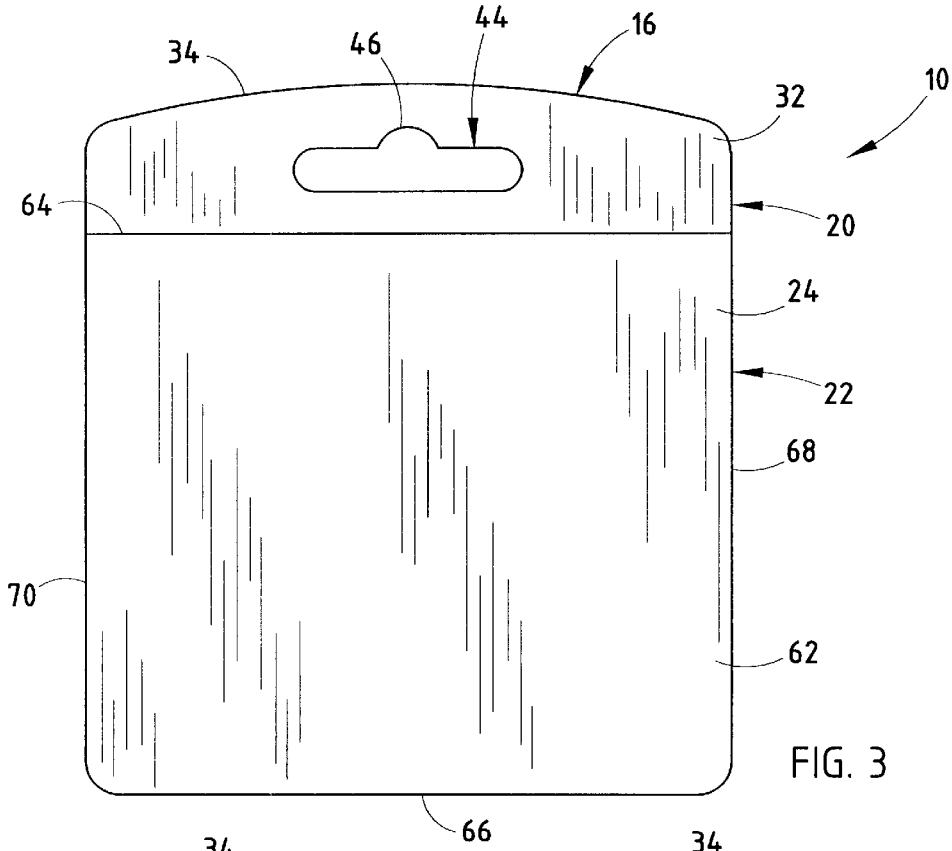
FIG. 3 is a rear view of the battery package of the first embodiment of the present invention.
Figure 4:
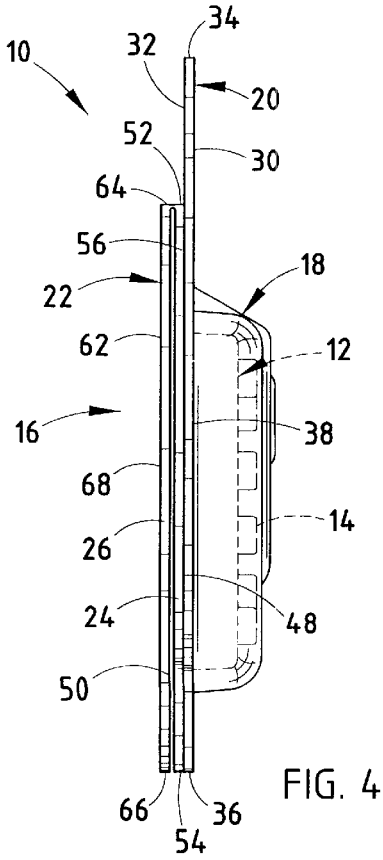
FIG. 4 is a left side view of the battery package of the first embodiment of the present invention.
Figure 5:
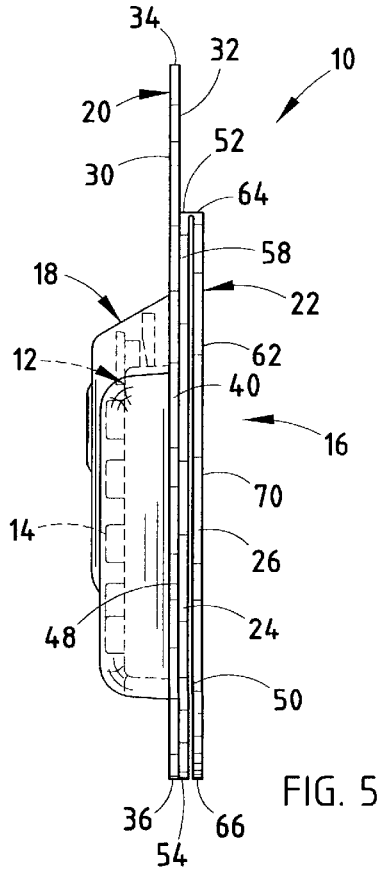
FIG. 5 is a right side view of the battery package of the first embodiment of the present invention.
Figure 6:
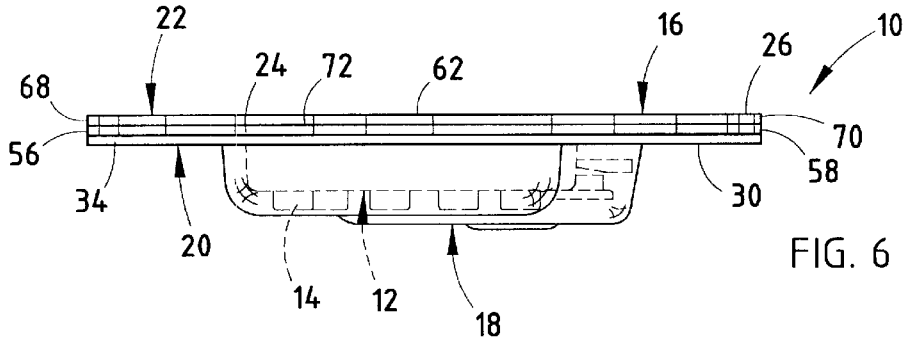
FIG. 6 is a top view of the battery package of the first embodiment of the present invention.
Figure 7:
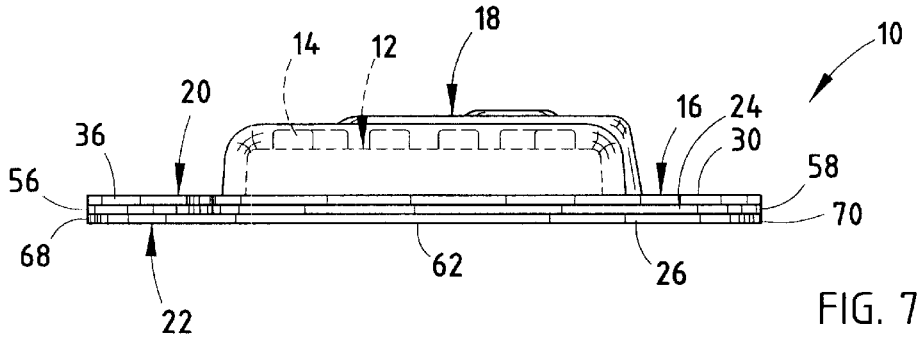
FIG. 7 is a bottom view of the battery package of the first embodiment of the present invention.
Figure 8:
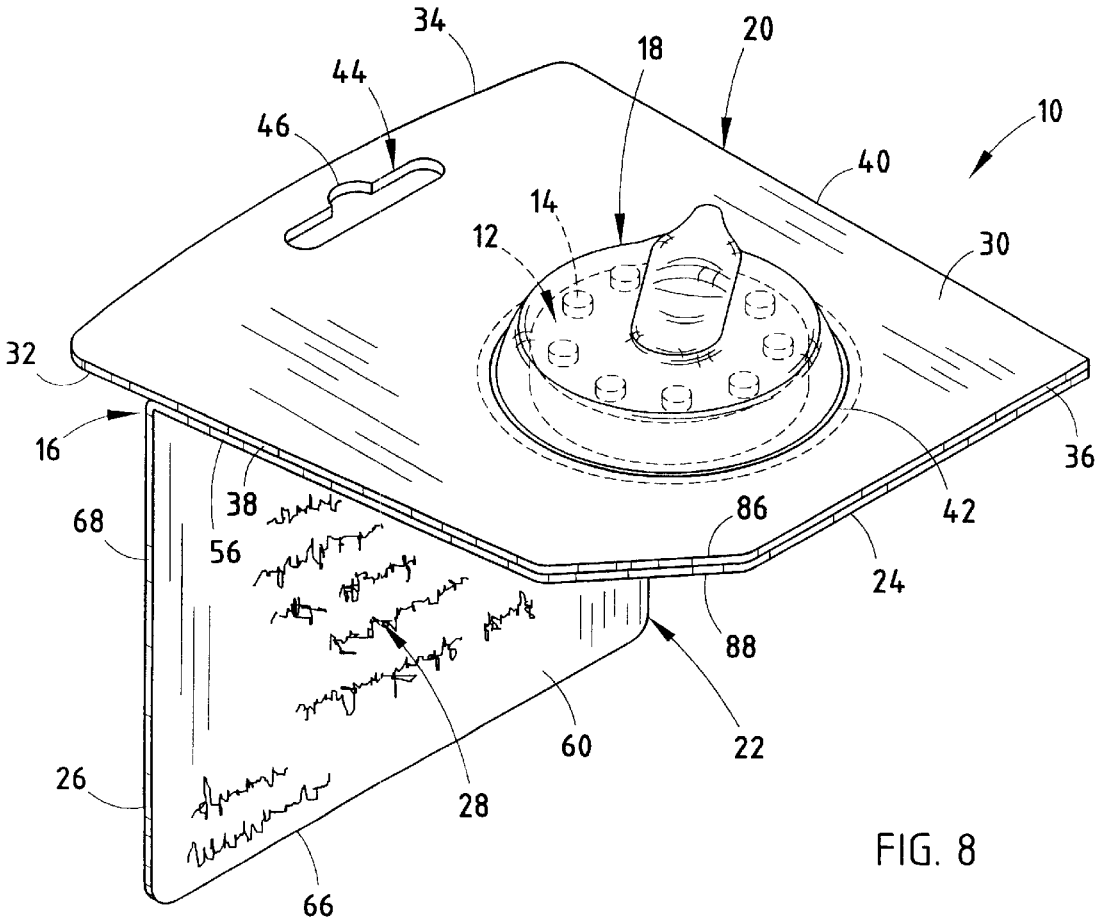
FIG. 8 is a perspective view of the battery package in a partially open position of the first embodiment of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 9:
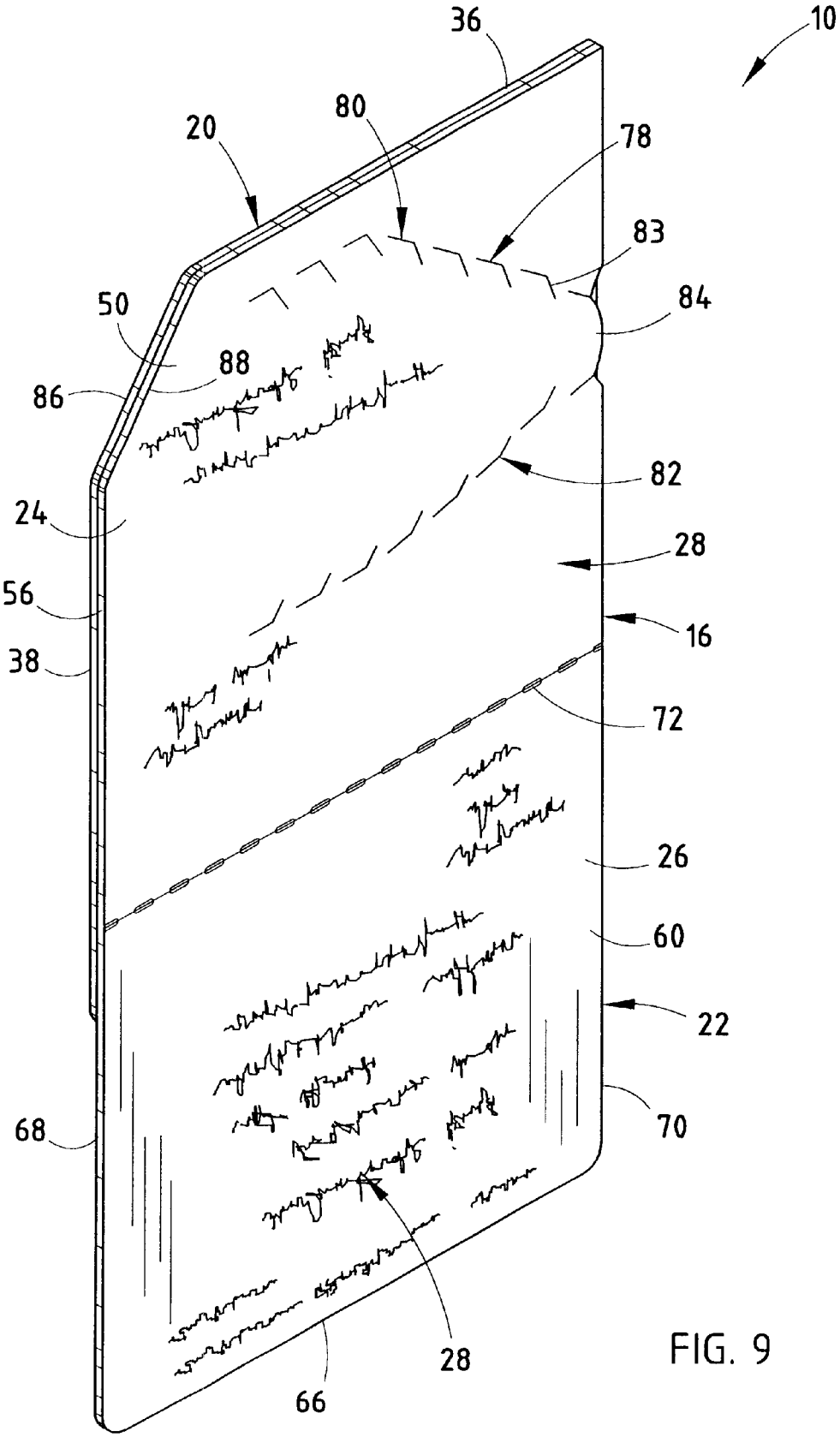
FIG. 9 is a perspective view of the battery package in an open position of the first embodiment of the present invention.
Figure 10:
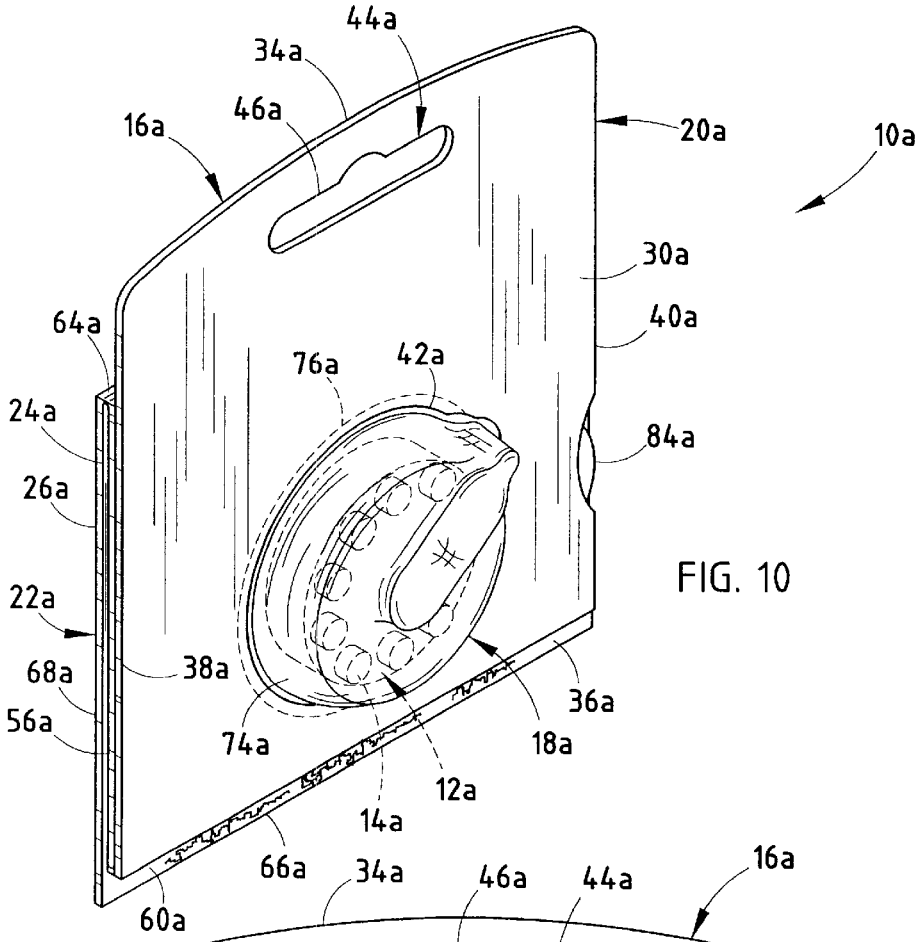
FIG. 10 is a perspective view of a battery package in a closed position of a second embodiment of the present invention.
Figure 11:
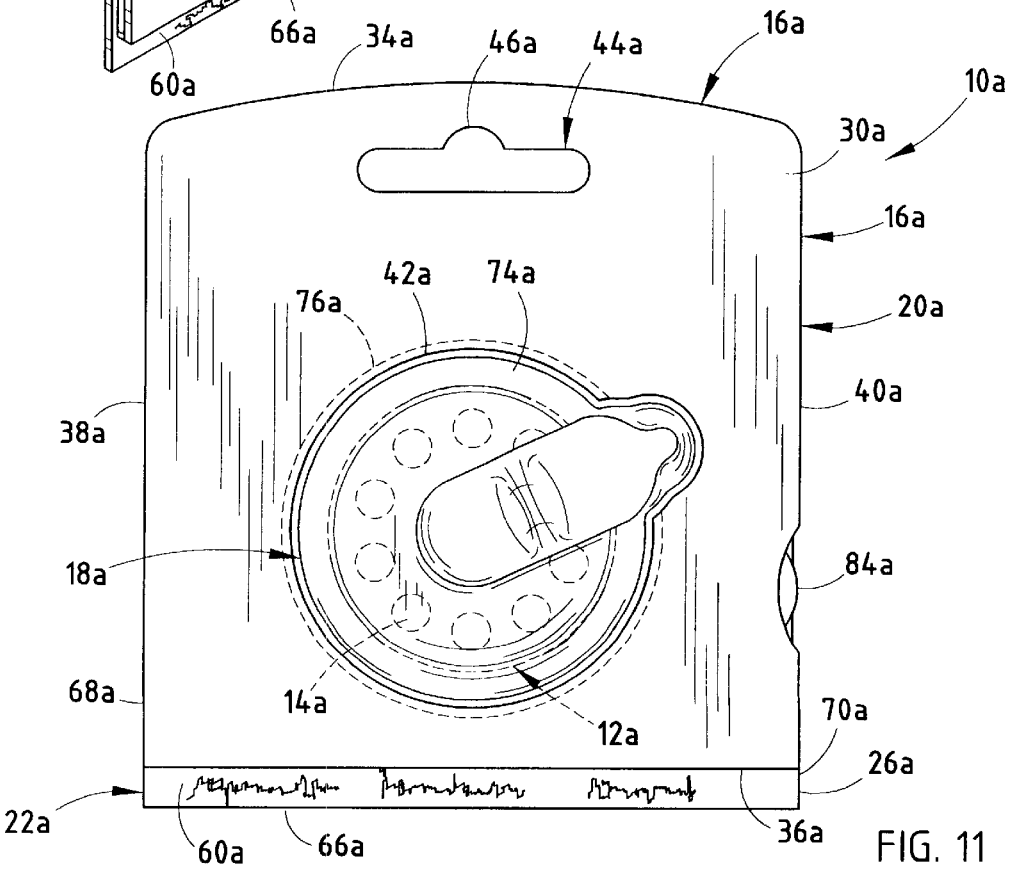
FIG. 11 is a front view of the battery package of the second embodiment of the present invention.
Figure 12:
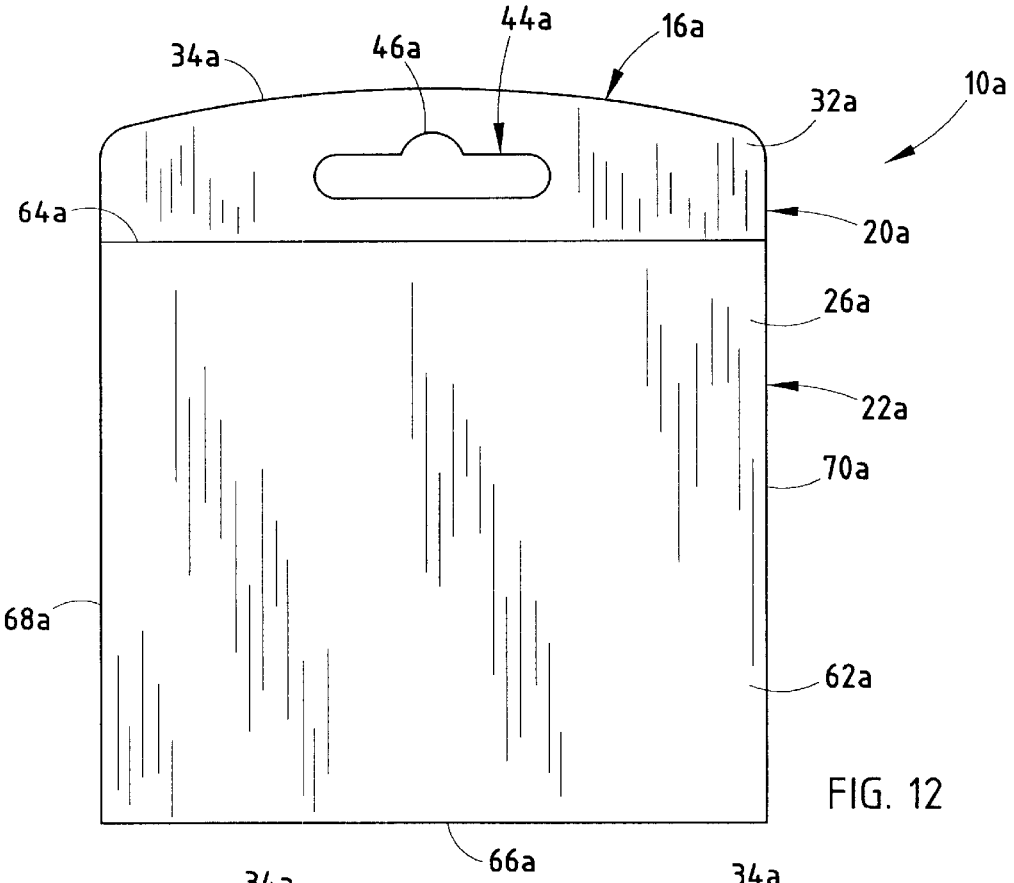
FIG. 12 is a rear view of the battery package of the second embodiment of the present invention.
Figure 13:
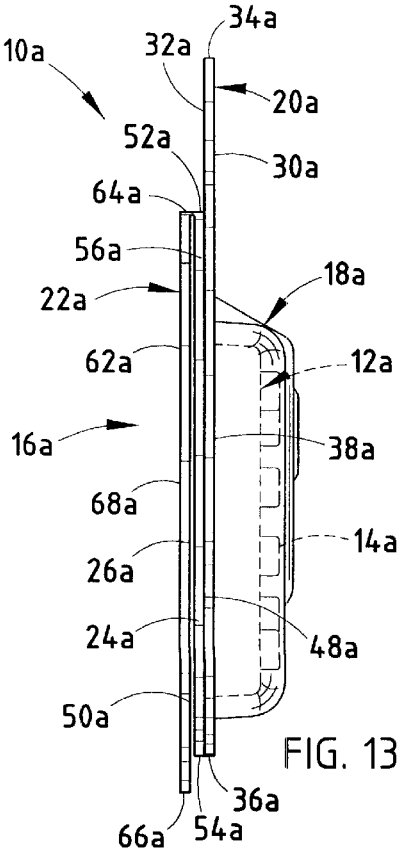
FIG. 13 is a left side view of the battery package of the second embodiment of the present invention.
Figure 14:
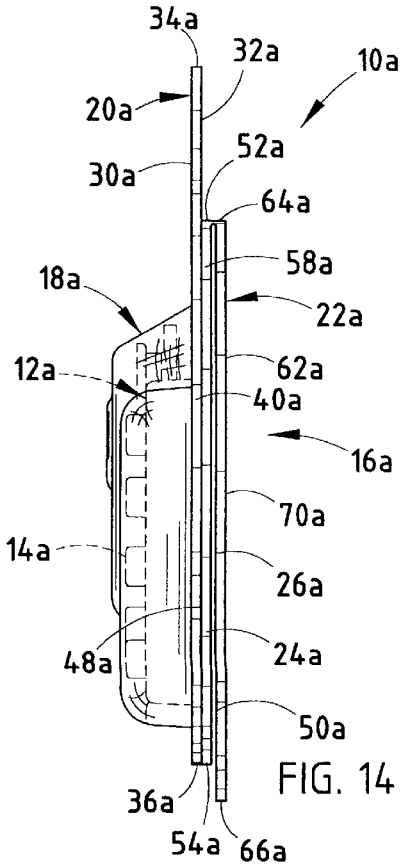
FIG. 14 is a right side view of the battery package of the second embodiment of the present invention.
Figure 15:
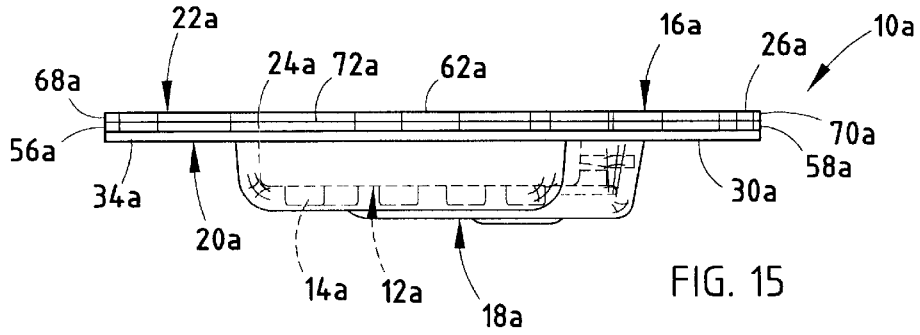
FIG. 15 is a top view of the battery package of the second embodiment of the present invention.
Figure 16:
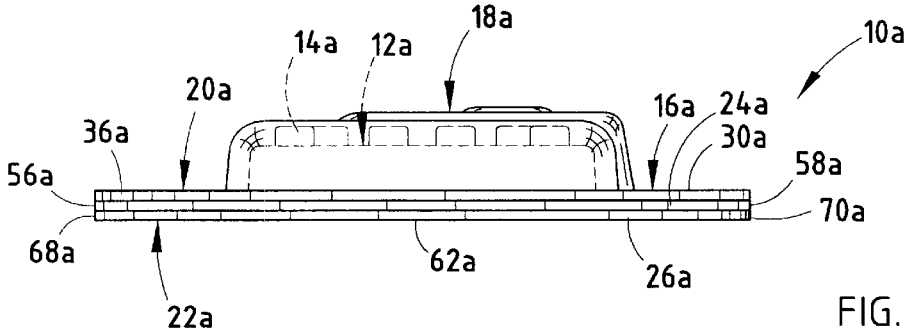
FIG. 16 is a bottom view of the battery package of the second embodiment of the present invention.
Figure 17:
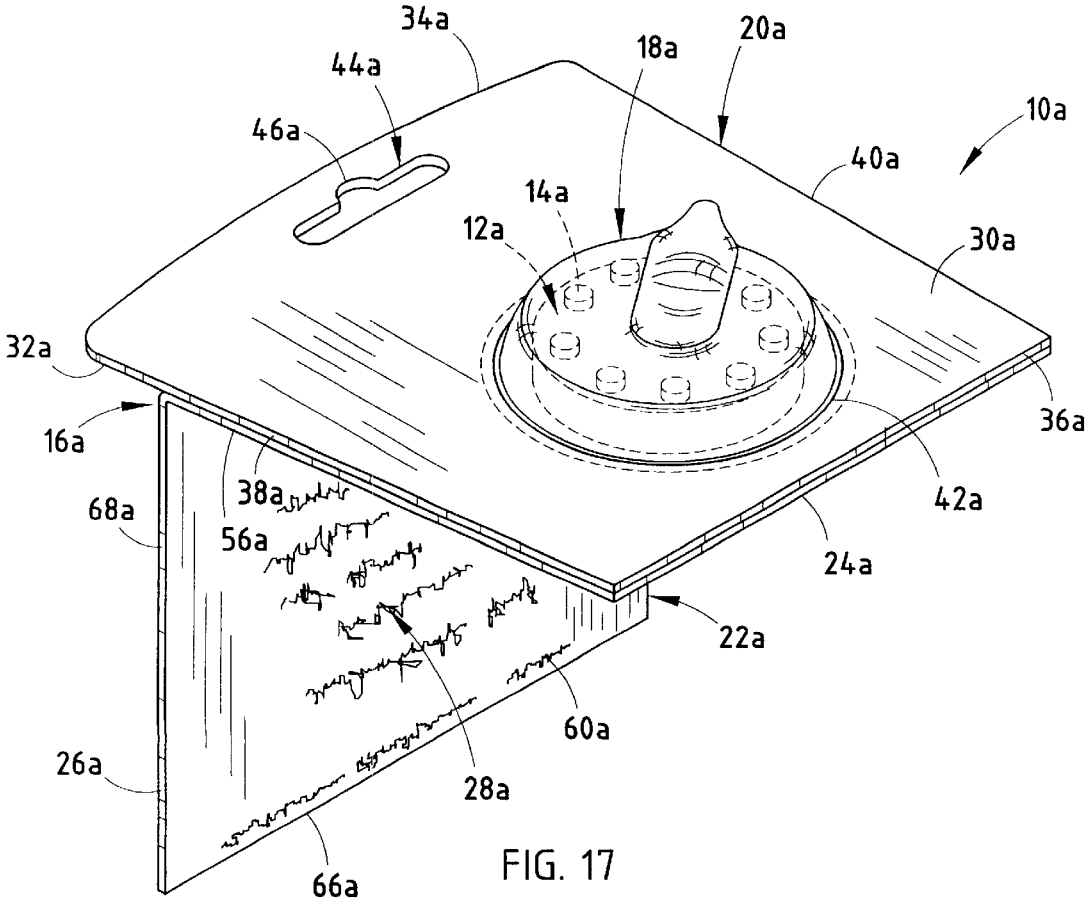
FIG. 17 is a perspective view of the battery package in a partially open position of the second embodiment of the present invention.
Figure 18:
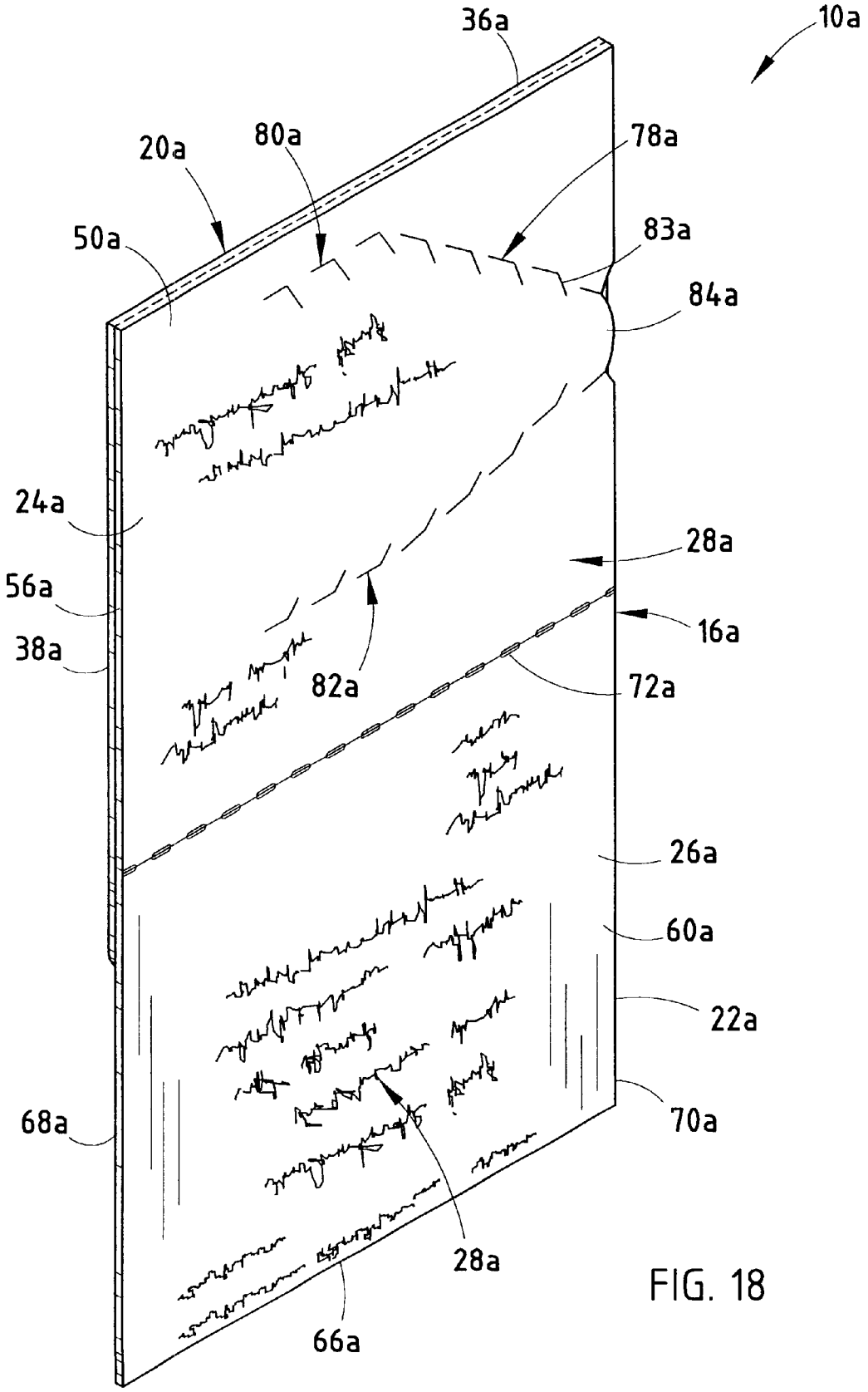
FIG. 18 is a perspective view of the battery package in an open position of the second embodiment of the present invention.

The reference number 10 (FIG. 1) generally designates a battery package of the present invention. The battery package 10 is for holding a battery dispenser 12 and batteries 14. The battery package 10 includes a backing 16 and a battery holder 18. The backing 16 includes a first board 20 and a second board 22. The second board 22 has a first sheet 24 pivotally connected to a second sheet 26. Furthermore, the first board 20 is connected to the first sheet 24 of the second board 22. The battery holder 18 is connected to the backing 16 and extends from the first board 20. The battery holder 18 is configured to retain the battery dispenser 12 and the batteries 14. The first sheet 24 and the second sheet 26 of the second board 22 include instructions 28 (see FIG. 9) for using the battery dispenser 12 and the batteries 14. The backing 16 has a closed position (FIG. 1) for displaying the batteries 12 and an open position (FIG. 9) wherein the first sheet 24 of the second board 22 and the first board 20 are flipped upward about the second sheet 26 of the second board 22 to allow a user of the batteries 14 to read the instructions 28.

In the illustrated example, the first board 20 (FIGS. 1–9) includes a front side 30, a rear side 32, a top edge 34, a bottom edge 36, a first side edge 38 and a second side edge 40. The first board has a centrally located opening 42, with the battery holder 18 extending out of the opening 42 away from the front side 30. The opening 42 is preferably substantially circular, although the opening 42 could have other shapes, depending on the batteries 14 and/or battery dispenser 12 located within the battery holder 18. The first board 20 also preferably includes a horizontal, oval aperture 44 for hanging the battery package 10 on a rod (not shown) in a store for displaying the batteries 14, the battery dispenser 12 and the battery package 10. The aperture 44 also preferably includes a centrally located enlarged, circular portion 46 for locating the rod about the center of gravity of the battery holder 10.

The illustrated second board 22 includes the first sheet 24 and the second sheet 26 Preferably, the first sheet 24 includes a front side 48, a rear side 50, a top, edge 52, a bottom edge 54, a first side edge 56 and a second side edge 58. Likewise, the second sheet 26 includes a front side 60, a rear side 62, a top edge 64, a bottom edge 66, a first side edge 68 and a second side edge 70. Preferably, the first sheet 24 and the second sheet 26 are formed from one board, with perforations 72 through the one board, thereby forming the first sheet 24 and the second sheet 26. Furthermore, when the second board 22 starts alit as one board, a cut is made partially though the one board defining the front side 48 of the first sheet 24 and the rear side 62 of the second sheet 26. The one board is then folded over so that the rear side 50 of the first sheet 24 can abut the front side 60 of the second sheet 26. It is further contemplated that the first sheet 24 and the second sheet 26 of the second board 22 could be separate sheets and be pivotally connected by tape or other similar means. The second board 22 is preferably connected to the first board 20 by applying an adhesive to the front side 48 of the first sheet or the rear side 32 of the first board 20 and forcing the front side 48 of the first sheet into the rear side 32 of the first board 20. Although the first board 20 and the second board 22 are shown as being separate, the battery package 10 is preferably made by folding a single board over twice to form the first board 20 and the second board 22. Therefore, the terminology of a first board and a second board includes separate boards or a single board folded at least once, and preferably twice, to define the first board 20 and the second board 22.

In the illustrated example, battery holder 18 is a transparent blister pack for displaying the batteries 14 and battery dispenser 12 located within the battery holder 18. The battery holder 18 preferably includes a pocket portion 74 conforming to the shape of the batteries 14 or the battery dispenser 12. The pocket portion 74 extends from the front side 30 of the first board 20. The battery holder 18 also includes a planar lip 76 extending from a periphery of the pocket portion 74. The battery holder 18 is preferably connected to the backing 16 by extending the pocket portion 74 through the opening 42 in the first board 20 before the second board 22 is connected to the first board 20. Therefore, the lip 76 will be flush against the rear side 32 of the first board 20. Consequently, when the second board 22 is connected to the first board 20, the lip 76 will be captured by the backing 16 between the second board 22 and the first board 20.

The illustrated first sheet 24 of the second board 22 includes a perforated portion 78 configured to be torn to allow access to batteries 14 and the battery dispenser 12 in the battery holder 18. The perforated portion 78 includes a first leg 80 and a second leg 82 extending away from each other and toward the second side edge 58 of the first sheet 24. The first leg 80 and the second leg 82 preferably comprise angled cuts 83 to facilitate tearing of the perforated portion 78. The first sheet 24 of the second board 22 includes a tab 84 located between the first leg 80 and the second leg 82 of the perforated portion 78. The first leg 80 and the second leg 82 of the perforated portion 78 extend into a central portion of the first sheet 24 behind the opening 42 in the first board 20. Therefore, the batteries 14 and the battery dispenser 12 can be accessed by pulling the tab 84 and tearing the perforated portion 78 to remove the batteries 14 and the battery dispenser 14 from the battery package 10.

In the illustrated example, the top edge 34 of the first board 20 extends above the top edge 52 of the first sheet 24 and the top edge 64 of the second sheet 26. Therefore, the aperture 44 in the first board 20 is not covered. Furthermore, the bottom edge 36 of the first board 20, the bottom edge 54 of the first sheet 24 and the bottom edge 66 of the second sheet 26 are located substantially an equal distance from the top edge 34 of the first board 20. The first board 20 includes an angled edge 86 between the bottom edge 36 of the first board 20 and the first side edge 38 of the first board 20. Likewise, the first sheet 24 of the second board 22 includes an angled edge 88 between the bottom edge 54 of the first sheet 24 and the first side edge 56 of the first sheet 24, with the angled edge 86 of the first board 20 overlaying the angled edge 88 of the first sheet 24. Therefore, a portion of the front side 60 of the second sheet 26 is exposed.

Figure 19:
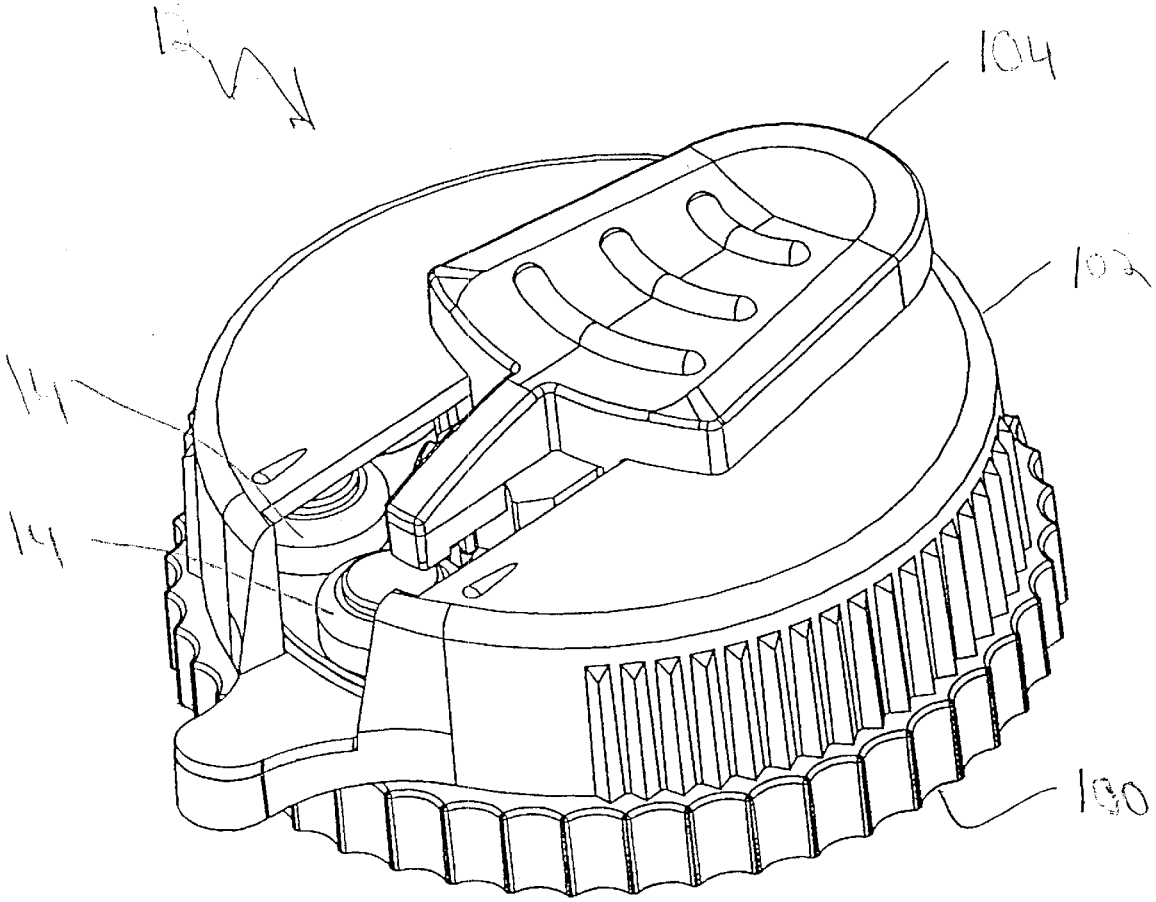
FIG. 19 is a perspective view of a battery dispenser of the present invention.

The illustrated battery package 10 is used to hold the illustrated battery dispenser 12 and batteries 14. The battery dispenser 12 (FIG. 19) preferably includes a base 100, a cover 102 and a retractable push element 104. The battery dispenser 12 holds hearing aid batteries 14. The cover 102 rotates to align the batteries with the push element 104. The push element 104 will move one of the batteries out of the battery dispenser 12 when the retractable push element 104 is slid outward. The hearing aid batteries 14 in the illustrated embodiment are ENERGIZER® size 312 hearing aid batteries sold by Eveready Battery Company, Inc. of Cleveland, Ohio. Furthermore, the battery dispenser 12 is preferably one of the battery dispensers disclosed in co-assigned and co-pending U.S. patent application Ser. No. 09/658,201 entitled PRODUCT DISPENSER the entire content of which is hereby incorporated by reference, or in co-assigned and co-pending U.S. patent application Ser. No. 09/764,579 entitled PRODUCT DISPENSER, the entire contents of which is hereby incorporated by reference. It is contemplated that other battery dispensers or batteries of any size could also be located within the battery holder 18. For example, D-, C-, AA-, AAA-, and AAAA-size batteries could be located within the battery holder 18 without a battery dispenser 12.

In the illustrated example, instructions 28 for using the battery dispenser 12 are located on the rear side 50 of the first sheet 24 and the front side 60 of the second sheet 26. With the instructions 28 on the first sheet 24 and the second sheet 26, larger sized fonts and larger drawings can be used than on the back of a typical battery package. Consequently, users of the batteries 14 and the battery dispenser 12 that have a hard time reading small font instructions will be able to easily read the instructions 28 on the battery package 10. Furthermore, the portion on the second sheet 26 exposed by the angled edge 86 of the first board 20 and the angled edge 88 of the first sheet 24 will allow buyers of the batteries 14 to know that instructions 28 are on the first sheet 24 and the second sheet 26. It is contemplated that supplemental instructions could also be located on the rear side 62 of the second sheet 26. Furthermore, the second sheet 26 may be torn along the perforated fold line 72 for removal of all or a portion of the printed instructions 28. Therefore, the instructions 28 can survive a tearing of the perforated portion 78 of the first sheet 24 during removal of the batteries 14 from the battery package 10.

The illustrated battery package 10 includes the closed position (FIG. 1) for displaying the batteries 12 wherein the rear side 50 of the first sheet 24 overlays the front side 60 of the second sheet 26. The battery package 10 also includes the open position (FIG. 9), wherein the first sheet 24 of the second board 22 and the first board 20 are flipped upward about the top edge 64 the second sheet 26 of the second board 22 to allow a user of the batteries 14 to read the instructions 28.

The reference numeral 10*a* (FIGS. 10–18) generally designates a second preferred embodiment of the invention, having a second preferred embodiment of the battery package. Since battery package 10*a* is similar to the previously described battery package 10, similar parts appearing in FIGS. 1–9 and FIGS. 10–18, respectively, are represented by the same, corresponding reference numeral, except for the suffix "a" in the numerals of the latter. In the illustrated battery package 10*a*, the bottom edge 36*a* of the first board 20*a* and the bottom edge 54*a* of the first sheet 24*a* are located substantially an equal distance from the top edge 34*a* of the first board 20*a*. Furthermore, the bottom edge 66*a* of the second sheet 26*a* extends downward from the bottom edge 36*a* of the first board 20*a* and the bottom edge 54*a* of the first sheet 24*a*. Consequently, a portion of the second sheet 26*a* is exposed to allow buyers of the batteries 14*a* to know that instructions 28*a* are on the first sheet 24*a* and the second sheet 26*a*.

In the forgoing description, it will be readily appreciated by those skilled in the art that modifications may be made to the invention without departing from the concepts disclosed herein. Such modifications are to be considered as included in the following claims, unless these claims by their language expressly state otherwise.

We claim:

1. A battery package for holding batteries comprising:

a backing including a first board and a second board, the second board having a first sheet pivotally connected to a second sheet, the first board being connected to the first sheet of the second board;

a battery holder that is at least partially transparent and that is connected to the backing and extending from the first board, the battery holder being configured to retain the batteries; and the first sheet and the second sheet of the second board including instructions for using the batteries;

wherein:

the battery holder is adapted for holding hearing aid batteries;

the first sheet includes a top edge, the second sheet includes a top edge and the first sheet top edge is pivotably connected to the second sheet top edge; and the backing has a closed position for displaying the batteries and an open position wherein the first sheet of the second board and the first board are flipped upward about the second sheet of the second board to allow a user of the batteries to read the instructions.

2. The battery package of claim 1, wherein:

the first board includes an opening;

the battery holder includes a pocket portion for holding batteries and a planar lip extending from a periphery of the pocket portion; and the planar lip is located between the first board and the first sheet of the second board to connect the battery holder to the backing, and the pocket portion extends out of the opening in the first board.

3. The battery package of claim 1, wherein:

the first sheet of the second board includes a perforated portion configured to be torn to allow access to batteries in the battery holder.

4. The battery package of claim 3, wherein:

the perforated portion includes a first leg and a second leg extending to an edge of the first sheet of the second board;

the first sheet of the second board includes a tab between the first leg and the second leg; and the perforated portion is removed from the first sheet of the second board by pulling the tab.

5. The battery package of claim 1, wherein;

the first board includes a first board top edge and a first board bottom edge;

the first sheet of the second board includes a first sheet bottom edge;

the second sheet of the second board includes a second sheet bottom edge; and the first board top edge extends above the first sheet top edge and the second sheet top edge.

6. The battery package of claim 5, wherein:

the first board bottom edge, the first sheet bottom edge and the second sheet bottom edge are located substantially an equal distance from the first board top edge.

7. The battery package of claim 6, wherein:

the first board includes a first board angled edge between the first board bottom edge and a board side edge, and the first sheet of the second board includes a first sheet angled edge between the first sheet bottom edge and a first sheet side edge, the first board angled edge overlaying the first sheet angled edge to thereby expose a portion of the second sheet.

8. The battery package of claim 5, wherein:

the first sheet bottom edge and the first board bottom edge are located substantially an equal distance from the first board top edge; and the second sheet bottom edge extends below the first sheet bottom edge and the first board bottom edge.

9. The battery package of claim 1, wherein:

the first board includes an aperture located above the second board, the aperture configured to accept a rod for hanging the backing on the rod.

10. A battery package comprising:

a backing including a first panel and a second panel, the second panel having a first sheet pivotally connected to a second sheet, the first panel being connected to the first sheet of the second panel;

a battery holder connected to the backing and extends from the first panel; and hearing aid batteries located within the battery holder;

at least a portion of the first sheet and the second sheet of the second panel including instructions for using the batteries;

wherein the first sheet includes a top edge, the second sheet includes a top edge and the first sheet top edge is pivotably connected to the second sheet top edge; and the backing has a closed position for displaying the batteries and an open position wherein the first sheet of the second panel and the first panel are flipped upward about the second sheet of the second panel to allow a user of the batteries to read the instructions.

11. The battery package of claim 10, wherein:

the battery holder is at least partially transparent.

12. The battery package of claim 10, wherein:

the first panel includes an opening;

the battery holder includes a pocket portion for holding batteries and a planar lip extending from a periphery of the pocket portion; and the planar lip is located between the first panel and the first sheet of the second panel to connect the battery holder to the backing, and the pocket portion extends out of the opening in the first panel.

13. The battery package of claim 10, wherein:

the first sheet of the second panel includes a perforated portion configured to be torn to allow access to batteries in the battery holder.

14. The battery package of claim 13, wherein:

the perforated portion includes a first leg and a second leg extending to an edge of the first sheet of the second panel;

the first sheet of the second panel includes a tab between the first leg and the second leg; and the perforated portion is removed from the first sheet of the second panel by pulling the tab.

15. The battery package of claim 10, wherein:

the first panel includes a first panel top edge and a first panel bottom edge;

the first sheet of the second panel includes a first sheet bottom edge;

the second sheet of the second panel includes a second sheet bottom edge: and the first panel top edge extends above the first sheet top edge and the second sheet top edge.

16. The battery package of claim 15, wherein:

the first panel bottom edge, the first sheet bottom edge and the second sheet bottom edge are located substantially an equal distance from the first panel top edge.

17. The battery package of claim 16, wherein:

the first panel includes a first panel angled edge between the first panel bottom edge and a panel side edge, and the first sheet of the second panel includes a first sheet angled edge between the first sheet bottom edge and a first sheet side edge, the first panel angled edge overlaying the first sheet angled edge to thereby expose a portion of the second sheet.

18. The battery package of claim 15, wherein:

the first sheet bottom edge and the first panel bottom edge are located substantially an equal distance from the first panel top edge; and the second sheet bottom edge extends below the first sheet bottom edge and the first panel bottom edge.

19. The battery package of claim 10, wherein:

the first panel includes an aperture located above the second panel, the aperture configured to accept a rod for hanging the backing on the rod.

20. The battery package of claim 10, further including:

a battery dispenser located within the battery holder;

wherein the batteries are located within the battery dispenser.

21. A battery package comprising:

a backing having a first layer and a second layer pivotally connected to the first layer at a pivot connection point;

said first layer including a first layer top edge and a first layer bottom edge, said second layer including a second layer top edge and a second layer bottom edge, with said first layer top edge extending above the second layer top edge;

a battery holder connected to the backing and extending from the first layer; and batteries located within the battery holder;

the backing including an aperture configured to accept a rod for hanging the backing and displaying the batteries, the aperture being located above the battery holder;

the second layer including instructions for using the batteries;

wherein the backing has a closed position for displaying the batteries and an open position wherein the first layer is flipped about the second layer to allow a user of the batteries to read the instructions.

22. The battery package of claim 21, wherein:

the aperture is located between said first layer top edge and the pivotal connection point.

23. The battery package of claim 21, wherein:

the battery holder is at least partially transparent.

24. The battery package of claim 21, wherein:

the first layer bottom edge and the second layer bottom edge are located substantially an equal distance from the first layer top edge.

25. The battery package of claim 24, wherein:

the first layer includes an angled edge between the first layer bottom edge and a side edge, thereby exposing a portion of the second layer.

26. The battery package of claim 21, wherein:

the second layer bottom edge extends below the first layer bottom edge.

27. The battery package of claim 21, further including:

a battery dispenser located within the battery holder;

wherein the batteries are located within the battery dispenser.

* * * * *